United States Patent [19]

Stephenson

[11] 4,096,606

[45] Jun. 27, 1978

[54] FERRULE BUCKLE WITH SLIDING RELEASE BUTTON

[75] Inventor: Robert Larry Stephenson, Sterling Heights, Mich.

[73] Assignee: Allied Chemical Corporation, Morris Township, N.J.

[21] Appl. No.: 663,942

[22] Filed: Mar. 4, 1976

[51] Int. Cl.[2] ..... A44B 11/25

[52] U.S. Cl. ..... 24/230 A

[58] Field of Search ..... 24/230 A, 230 AV, 230 AK, 24/230 AL, 230 AT

[56] References Cited

U.S. PATENT DOCUMENTS

| | | | |
|---|---|---|---|
| 2,581,557 | 1/1952 | Rozas | 24/230 A |
| 3,112,907 | 12/1963 | Gaylord | 24/230 A |
| 3,597,811 | 8/1971 | Cunningham | 24/230 AV |

FOREIGN PATENT DOCUMENTS

| | | | |
|---|---|---|---|
| 36,402 | 2/1909 | Austria | 24/230 A |
| 70,520 | 8/1893 | Germany | 24/230 AV |

*Primary Examiner*—Bernard A. Gelak

*Attorney, Agent, or Firm*—Roger H. Criss

[57] ABSTRACT

A safety buckle and tongue combination requiring a minimal effort to unlatch, even under conditions of great stress, yet having a high degree of strength and reliability. The tongue is accepted by the slotted end of a ferrule, and latching is accomplished by latching teeth extending downward from a latch member which straddles the ferrule and is pivoted thereto, for engagement with openings in the tongue exposed on each side of the ferrule. The teeth are securely locked into latching engagement with the tongue, yet are readily disengaged by a wedge cooperating with the latching member in response to slight pressure on a sliding release button.

11 Claims, 5 Drawing Figures

FERRULE BUCKLE WITH SLIDING RELEASE BUTTON

CROSS-REFERENCE TO RELATED APPLICATIONS

This application is related to a U.S. patent application Ser. No. 663,943, filed Mar. 4, 1976 entitled, "Ferrule Buckle Having Pin Latch and Through Slot", filed in the name of R. L. Stephenson and J. Schotthoefer and U.S. patent application Ser. No. 663,636, filed Mar. 4, 1976, entitled "Improved Ferrule Buckle", filed in the name of P. O. Weman, now Pat. No. 4,069,559 issued Jan. 24, 1978 both filed concurrently herewith and assigned to the same assignee as the present patent application.

BACKGROUND OF THE INVENTION

1. Field of the Invention

This invention relates to a buckle and tongue combination of the type used in automobiles, airplanes and other vehicles for retaining an occupant in a seated position within the vehicle. With many of these the buckle is attached to the frame or body of the vehicle by a relatively short rigid or semi-rigid connector, and the cooperating tongue is attached to one or two flexible passenger restraints disposed over the lap, or the lap and chest of the user, and also attached to the body or frame of the vehicle. In other passenger restraint systems both tongue and buckle are attached to flexible restraints which are attached to the frame or body of the vehicle. These are buckled together across the lap, or lap and chest of the user.

2. Description of the Prior Art

A large number of such buckle and tongue combinations are found in the prior art, practically all of which incorporate a buckle having some type of latching means co-acting with a tongue. Many of these have an independent latching member within a cast metal or predominantly plastic housing, and frequently the connection between the release button or lever, and the latching member is indirect. A ferrule is disclosed in U.S. patent application Ser. No. 621,971 as a mounting means for a buckle.

It is an object of the present invention to provide a rugged and functional safety buckle and tongue combination which cannot be unlatched by the application of stress, yet a buckle wherein the tongue can be released by the application of a relatively small force by the user, even when the buckle is under stress. It is also an object of this invention to provide a buckle wherein the strength of the connection between the tongue at one end and the attached passenger restraint at the other, is independent of the housing or the secondary components. In the buckle of this invention the tongue is not only latched, but locked to the ferrule, and the ferrule is fixedly attached to a passenger restraint such as a steel cable. The connection is both simple and reliable.

SUMMARY OF THE INVENTION

The present invention is directed to a positive-acting buckle and tongue combination. The basic structure is an elongated ferrule. By the term "ferrule" I mean an elongated metal member which constitutes the connecting link between the tongue at one end and the passenger restraint at the other. The shape of the ferrule is not critical, but preferably the ferrule is cylindrical.

In the buckle of the present invention the tongue latches to the ferrule so that a direct connection is had between the tongue and the restraint attached to the ferrule. Preferably, the components making up this direct connection, namely the tongue, ferrule, latch member and pivot pin are fabricated of metal. The remaining components which include the housing, the components support member, the tongue ejector, the sliding release button and the latch control member may also be metal, but preferably are fabricated of a polymeric material such as polypropylene. The use of such materials for these components reduces the weight of the buckle and provides smooth action without weakening the buckle, for these components are under substantially no strain or tension.

Briefly, the ferrule of the present invention has a longitudinal slot for accepting the tongue at one end, and means at the other for the attachment of the passenger restraint. The passenger restraint for attachment to the buckle preferably consists of a length of cable. This can be inserted into a cylindrical opening at the end of the ferrule and attached by crimping. In the preferred embodiment, the tongue has two openings therethrough, so spaced, that a portion of each opening remains exposed at the corresponding side of the ferrule when the tongue is positioned within the slot of the ferrule. The tongue also has an elongated opening for the attachment of another passenger restraint, preferably a seat belt.

A latch member closely straddles the ferrule, having two parallel latching teeth extending downward from its forepart, one on each side of the ferrule, for engaging the exposed portion of each of the two openings of the tongue. The latch member is pivotally attached to the sides of the ferrule for limited rotation in and out of latching engagement with the tongue. An elongated latch control member extends longitudinally along the top surface of the forepart of the ferrule and beneath the straddling latch member, for limited horizontal sliding action, said latch control member preferably being an integral part of the sliding release button which is accessible from the front end of the buckle. The sliding release button and attached latch control member are biased toward the front of the buckle, parallel to the ferrule.

The latch control member has two inclined planes or ramps on its upper surface, which will hereinafter be referred to as wedges. These wedges are an integral part of the latch control member sloping smoothly upward therefrom, the first being adjacent to the inner surface of the sliding push button as well as to the forepart of the latch member. This wedge slopes upward and forward and is adapted for rocking or rotating the latch member to its unlatched position as the latch control member carrying this wedge slides toward the rear of the buckle against its bias. The second wedge slopes upward and backward from a depressed section of the surface of the latch control member, said depressed section being substantially shaped to accept the rear part of the latch member when said latch member is rotated back to its unlatched position. This short wedge is adapted, as the latch control member slides forward, for rotating the latch member to its latched position, said short wedge ending its forward travel beneath the rear part of the latch member to thereby scotch the latch member in its latched position. Preferably at the top of the short ramp or wedge, a small level area extends a short distance toward the rear of the latch control member, thus forming a scotching block for providing good support for the raised end of the latching member, and locking it in its latched position. This is a novel arrangement. Most prior art buckles have latches which are spring biased into latching engagement, hence the latch teeth must be carefully shaped to prevent their being forced out of openings in the tongue when under stress. Since the latching teeth of my invention are positively locked into the tongue, the inner surfaces of the latching teeth which retain the tongue, need not be perpendicular to the surface of the tongue, but preferably slant upward and backward for easy withdrawal under stress.

A tongue ejector having parallel sides separated by a distance greater than the width of the latch member, is adapted for the limited longitudinal motion of its parallel sides along the outer surface of the latch member, from a first position in contact with the tip of the inserted and latched tongue, to a second forward position toward which it is biased in ejecting the unlatched tongue from the buckle. The parallel sides of the ejector are connected by a bridge over the ferrule, of a height such that in the forward travel of the ejector, the bridge comes to rest directly over the rear part of the latch member when the latch member is unlatched and seated in the depressed section of the latch control member. The latch member is therefore captured in its unlatched position and its rear part is retained in the depression of the latch control member. Consequently the slide push button and attached latch control member is prevented from moving outwardly in response to the applied bias.

In operation, the tongue, when inserted, forces back the tongue ejector against its bias, thus releasing both the latch member and the latch control member. The latch control member and attached sliding push button move forward in response to their spring bias, rotating the latch member into latching engagement with the tongue, and scotching the latch member in its latched position.

To release the tongue, a slight pressure is applied to the sliding release button which now extends a short distance beyond the front of the buckle. The required pressure is minimal, first because a mechanical advantage is to be had in using an inclined surface — the wedge — to rotate the latch member; second, because the rear edge of the latching teeth have an upward and backward slant, so that stress on the tongue actually adds to, rather than subtracts from, the ease of unlatching the latching teeth.

Once the tongue has been disengaged, the tongue ejector, in response to its spring bias, ejects the tongue and simultaneously captures the latch member in its unlatched position, while retaining the sliding release button and attached latch control member in their "pressed" position. Consequently, when the tongue is ejected, the sliding release button which has an upper lip along its bottom edge, contoured for guiding the tongue into the buckle, is flush with the front face of the buckle. It is retained in line with a lower lip, which constitutes the forward edge of the component support member. Both lips therefore are united to make up the elongated opening to the buckle for funneling the tongue into engagement with the slot of the ferrule within the buckle. As soon as the tongue is inserted, however, forcing back the tongue ejector against its bias, the released sliding release button springs out in readiness for the next time it becomes necessary to press it, to release the tongue.

DETAILED DESCRIPTION OF THE PREFERRED EMBODIMENT

Figure 1:
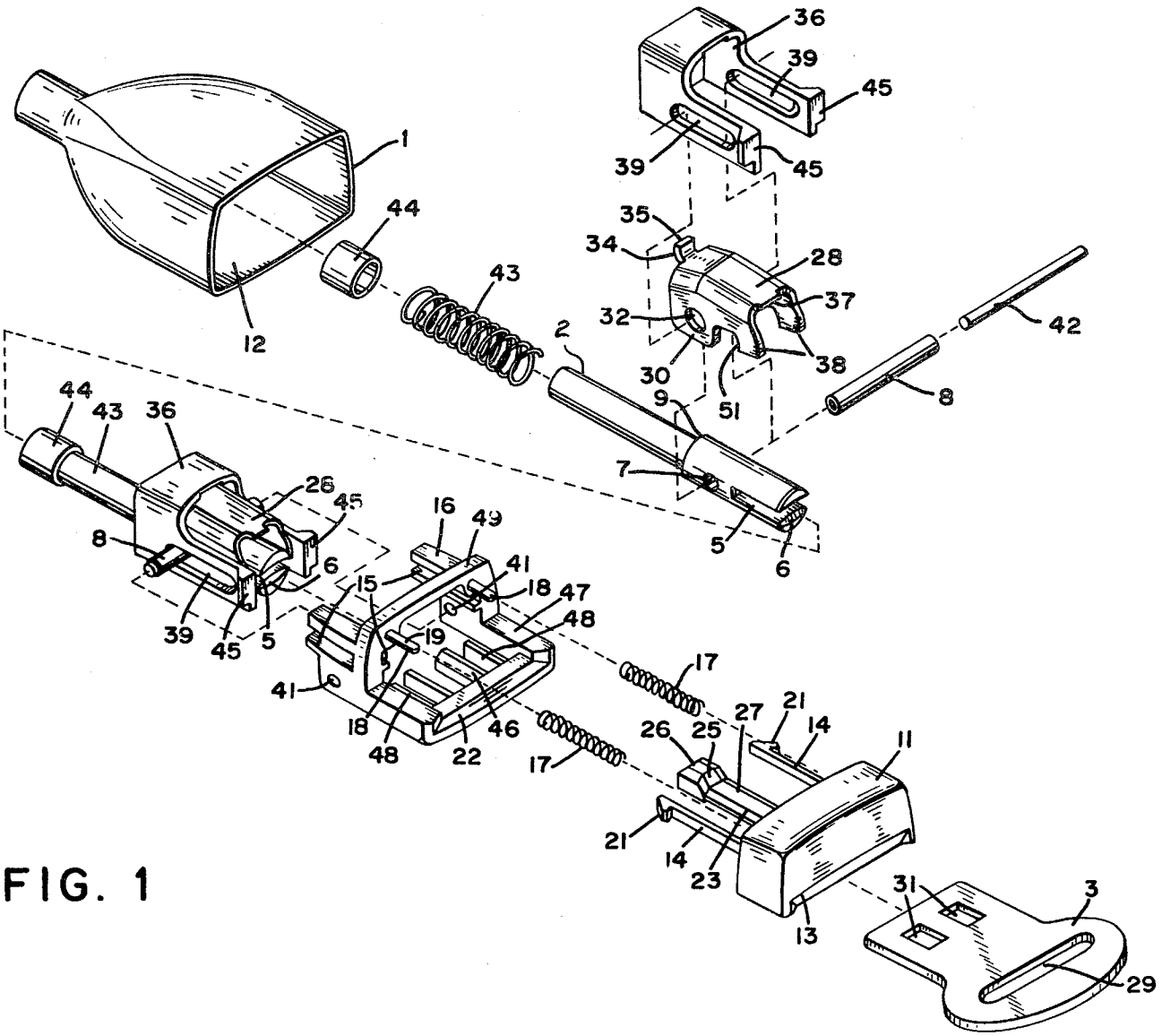
FIG. 1 is an exploded view of the buckle and tongue combination of the present invention.

With particular reference to FIG. 1, but also to FIGS. 2, 3, 4 and 5, my invention is directed to a safety buckle and tongue combination comprising: a safety buckle housing 1, having a large opening in the front end for the insertion of components of the buckle. A smaller opening is provided in the rear of the housing through which a cable or other passenger restraint is attached to a ferrule 2. By the term "ferrule" I mean in this instance, a connecting member which forms the link between the tongue when engaged thereto, and a cable, belt or other passenger restraint. The general shape of the ferrule is not critical, but preferably it is substantially cylindrical.

In the front end of the ferrule there is a longitudinal slot parallel to the axis of the ferrule for accepting tongue 3. The slot extends toward the rear for a distance at least equal to the length of that portion of tongue 3 which is to be inserted into said slot. The outer lips of the slot of the ferrule flare outwardly at 6, to increase the ease of inserting the tongue.

To the rear of the end of the slot there is a transverse cylindrical opening 7, lying in substantially the same plane as that of slot 6, of a diameter to accept cylindrical sleeve 8, or alternately, a solid metal pivot pin of the same diameter. To the rear of this transverse opening, the diameter of the cylindrical ferrule is reduced slightly to provide shoulder 9.

Slide release button 11 also comprises the major portion of the front face of the buckle, and slides into the upper part of the front opening 12 of housing 1. The lower edge of this slide release button is beveled and shaped inwardly at 13 to provide the upper lip of the entrance slot of the buckle. From each side of the inner surface of slide release button 11 there extends a guide shaft 14 which slides into corresponding groove 15 in a component support member 16. Also, on each side of the inner surface of the slide release button 11, just above the points from which the two guide shafts 14 extend, there are preferably shallow cylindrical recesses for positioning the ends of coiled springs 17. Coiled springs 17 at their rear end are of a size to slip over projections 18 of the component support member which extend from shallow cylindrical receses 19, for seating the rear end of the springs 17. The guide shafts 14 have at their very tips, outwardly projecting wedge-shaped hooks 21. Shafts 14 are flexible enough to allow these hooks to enter grooves 15 of the component support member, but when they reach the end of the grooves, shafts 14 seat into the grooves and the wedge-shaped hooks 21 snap over the ends of the groove, thus limiting the degree to which the slide release button can slide outwardly. The hooks 21 also prevent the slide release button from thereafter being removed from the assembly without bending shafts 14 inwardly. Since these shafts would not be accessible once the components are in housing 1, snapping the sliding release button into place would ordinarily be the last step in the assembly of the buckle. Springs 17 which now bias the sliding release button 11 outwardly from the component support member 16, should be of sufficient length and tension to permit pressure on the slide release button 11 to slide it in opposition to its bias, to a position where lip 13 of the slide release button is just above corresponding beveled lip 22 on the component support member 16. Correspondingly, when the slide release button is released by the insertion of the tongue, springs 17 should slide it outwardly until stopped by hooks 21.

Also, extending inwardly from about the center of the inner surface of the slide release button, and preferably an integral part thereof, is an elongated latch control member 23, the under surface of which is preferably contoured for sliding contact with the upper surface of ferrule 2. The upper surface of this latch control member is also contoured to provide a wedge 24 at the front end, and a smaller wedge 25 near the rear end, the upper part of which culminates in a flat section 26. This short wedge 25 extends upward from a depressed section 27 of the latch control member, said depressed section being shaped to receive the rear portion of the latch member 28 when it has been rotated back to its unlatched position.

When sliding release button 11 is placed with its attached elongated latch control member 23 in contact with the upper surface of ferrule 2, the bottom edge of the guiding lip 13 of the slide release button should be substantially in line with the upper edge of slot 5 of ferrule 2 so that lip 13 can guide tongue 3 into the slot.

Tongue 3 has an elongated opening 29 for the attachment of a safety belt or other passenger restraint. Also, the portion of the tongue for insertion into the buckle, contains two openings 31 positioned so that when the tongue is inserted into the ferrule, a good portion of these openings is exposed on a side of the ferrule. Now if slide release button 11 is extended outward to its limit, as in FIG. 3, and latch member 28 is positioned to straddle both the latch control member 23 and the ferrule, and the openings 32 of the latch member are aligned with transverse opening 7 in the ferrule, latching teeth 38 drop into the exposed portion of openings 31 on each side of the ferrule. This latch member 28 with U shaped cross-section is fabricated to closely straddle the elongated latch control member and the ferrule. Two rear legs 30 of the latch member extend below the axis of the ferrule and have in-line openings 32 for limited rotation of sleeve 8 which extends through transverse opening 7. This latch member 28 is preferably cut and stamped from heavy sheet metal. At its rear, a short extension 34 is turned smoothly upward forming both a rounded surface for sliding action with the short wedge 25 of the latch control member 23; and a projecting stop 35 which, acting against the under surface of the bridge 36 of the tongue ejector, as in FIG. 2, prevents the latching member 28 from rotating or rocking forward into its latched position.

At the forward end of latch member 28 there is also another short extension 37 turned smoothly upward, forming a rounded surface for sliding action with wedge 24 of the sliding release button 11. Two legs extend downward from the forward portion of this latch member 28 straddling the latch control member 23 and ferrule 2. These legs constitute the latching teeth 38 of the latching member 28. The forward upper section of the latching member is preferably sloped downward, for best action with the latch control member 23, beneath.

Figure 4:
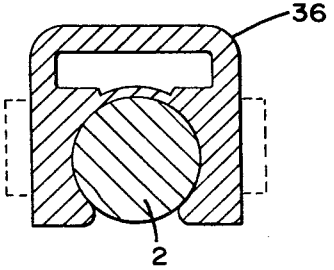
FIG. 4 is a transverse section taken through 4—4 of FIG. 2.

Tongue ejector 36 comprises two flat sides separated by a distance sufficient to closely but slideably sandwich the latch member 28 between them. These flat sides have matching elongated openings 39 to permit the ejector to slide backward and forward on the extended ends of metal sleeve 8. The rear portion of the tongue ejector 36 is bridged, and at the rear, as shown in the section of FIG. 4, it is shaped to slide along the rear cylindrical section of the ferrule 2.

When opening 7 in the ferrule, the openings 32 of the latch member 28, and the elongated openings of the tongue ejector 36 are aligned, metal sleeve 8 is inserted. This sleeve is of a length to just fit crosswise within component support member 16 at the point of openings 41. Sleeve 8 is sized to accept pivot pin 42 when pressed into the sleeve, so that when the sleeve 8 with the attached components 2, 28 and 36 is placed within the component support 16 in line with openings 41, the metal pivot 42 can be pressed through all the aligned openings to bring the moving components within the support. If desired, the pivot pin can be one piece of metal rod, reduced at each end, and put into place by bending the flexible sides of the component support member.

Alternately, the pivot pin may have a head at one end and be grooved at the other for accepting a snap ring. With such an arrangement, the component support can be eliminated, the ferrule attached directly to the housing, and the housing, particularly if prepared by injection molding, can contain the grooves and sliding surfaces for the sliding release button and tongue ejector as well as the cradle for positioning the ferrule.

Coiled spring 43 is slipped over the rear end of the ferrule 2 to press against the rear of tongue release 36, said spring being held in place by the cylindrical spacer 44 which is fixed to the end of the ferrule.

Each of the two slotted sides of the tongue release member 36 extend outwardly at the end, to form corresponding flat surfaces 45 for acting on the edge of the inserted tongue. These flat surfaces do not extend all the way to the bottom of the side walls, but are designed to ride grooves or guides 48 in the bottom of the component support.

Component support member 16 is preferably prepared by injection molding from polypropylene. In addition to the areas already described, it contains a cradle support 46 for the front end of the ferrule to position slot 6 just behind the beveled and contoured lip 22. This lip, in cooperation with the similar lip 13 of the tongue release button 11, forms the opening for the insertion of the tongue, and a funnel-like guide to the ferrule's slot within.

The outer sides of the component support member 16 fit the housing snugly, while its inner surfaces contain openings 41 for the pivot pin 42 as well as groove 15 for the guide shafts 14 of the sliding release button 11. They also provide surfaces 47 for the sliding action of sliding release button 11. The sides of the component support 16 are tied together at the bottom by the beveled contoured lip 22, for directing the tongue 3 into the buckle, in conjunction with lip 13 of the sliding release button 11.

The front of the component support 16, and the sliding release button 11 constitute the front face of the buckle. From the portion of the component support member containing the bottom lip 22, the cradle for the ferrule and the grooves for the tongue ejector 36 extend backward, to rest against the inner bottom surface of housing 1. The upper part of the sides of the component support member 16 are tied together by a bridge 49 which contacts the roof of housing 1, and from which extend projections 18 for coiled springs 17.

When the component support 16 is secured in housing 1, with its attached components, the end of the ferrule with the opening for crimping a steel cable, projects from the rear of the housing. The sliding release button can finally be inserted with the latch control member 23 slipping beneath the latch member, and the guide shafts 14 of the sliding release button slipping into groove 15 until their hooked ends 21 snap into place, thus completing the assembly.

Figure 2:
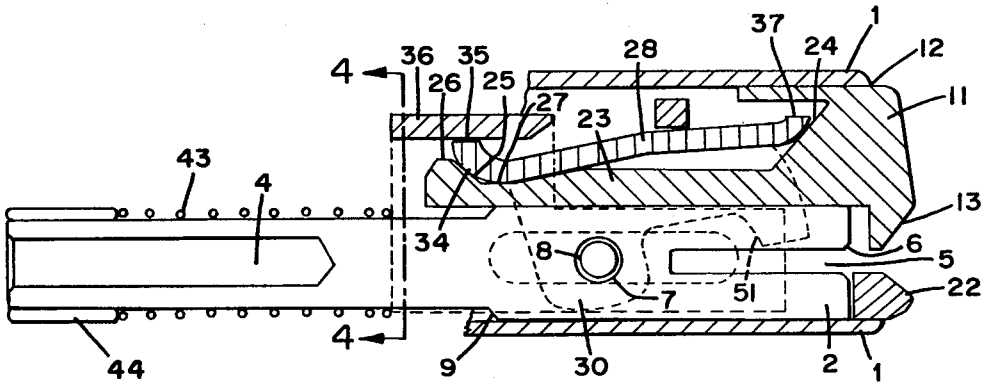
FIG. 2 is a partial longitudinal cross-section in elevation of the buckle without the tongue latched in place.

In operation, when the tongue has not been inserted, the situation exists as shown in FIG. 2. The sliding release button 11 is in line or flush with lip 22 of the component support member. Unlike most seat belt buckles, the latching teeth are not in the latched position, to be raised out of the way by the insertion of the tongue. The latching teeth 38 are held above the slot because the latch member 28 has rotated back about the pivot 8, and is retained in that position by the top of the tongue ejector 36 which is over the projection 35 of the latch member. The latching teeth of the majority of buckles slope downward so that the inserted tongue will raise them, but in the present invention it is unnecessary. The teeth in the present embodiment are stronger than if sloped since no metal is sacrificed in making the slant cut.

Figure 3:
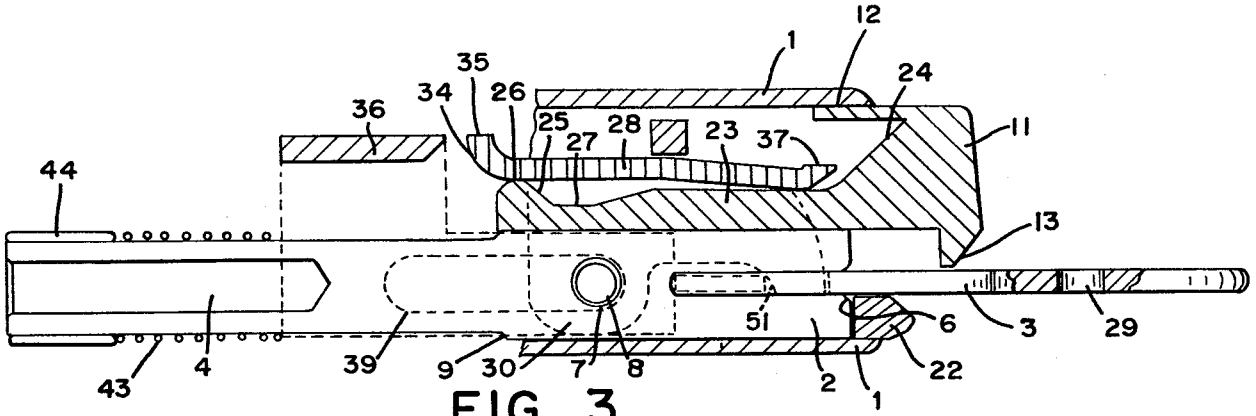
FIG. 3 is the same view as that of FIG. 2 with the exception that the tongue has been inserted into the buckle and latched into place. The effect that this action has on the moving components of the buckle, namely the release button the tongue ejector and the latch member, can be seen by comparing FIGS. 2 and 3.
Figure 5:
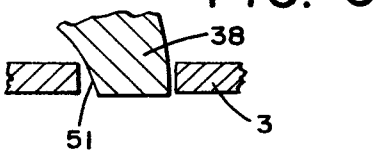
FIG. 5 is an enlarged partial cross-section taken through a latching tooth, latched into place through an opening in the tongue. This illustration shows the unusual shape of the latching tooth of one embodiment of my invention.

When tongue 3 is inserted into the buckle, it enters slot 5 of ferrule 2, and contacts the leading surfaces 45 of tongue ejector 36, forcing the ejector back against the bias of coiled spring 43. As the tongue ejector moves back, it uncovers the projection 35 of latch member 28. Coiled springs 17 now force the sliding release button 11 forward, for there is no longer anything retaining the end of the latch member 28 in seat 27 of the latch control member 23. It has been the seating of the rear end of the latch member that has been restraining the slide release button. As the springs 17 urge the sliding release button forward, the latch control member 23 which is an integral part of the sliding release button, slides forward and ramp or wedge 25 lifts the rear end of the latch member, causing the front end to rotate downward. The latching teeth 38 then engage that portion of the openings 31 of tongue 3 which extend beyond the sides of the ferrule. As the latch control member 23 slides still further, flat portion 26 slides under the rear end of the latch member 28 as shown in FIG. 3, scotching the latch member and locking the latching teeth securely in the openings 31 of the tongue.

Since the locking action is positive, it is an important feature of this invention to incorporate a slant cut at the rear of the latching teeth 38. In most buckles of the prior art the latching teeth are spring biased, and therefore the retaining surface of the teeth must be substantially perpendicular to the surface of the tongue. To introduce a slant surface as in 51 of FIG. 5, would permit the tongue to force up the teeth and withdraw when under strain. In the buckle of my invention, the teeth are not spring biased, but locked down in consequence of the latch member resting on flat portion 26 of the latch control member 23.

It is very desireable to be able to release the tongue from a buckle even when under great stress or tension such as might occur at the time of an accident. It is conceivable that a user might be feeble, especially if involved in an accident, yet the danger or existance of fire might make quick release of the passenger restraint imperative.

The present invention provides for a positive release, including forcible ejection of the tongue from the buckle, with minimal force on the sliding release button. This is achieved in two ways, first, when the tongue is latched, the slide release button 11 is extended. When this slide release button is pressed back against the slight bias of springs 17, flat area 26 of the latch control member 23 moves back, enabling end 35 of the latch member to drop into depression 27. Wedge 24 is forced under projection 37 of the latch member 28, lifting latching teeth 38 out of the openings 31 of the tongue. Since the wedge offers a mechanical advantage, a minimal force is required to release the tongue, yet until the sliding release button is depressed, the latching teeth are securely locked into the tongue.

The second method by which this tongue release is achieved with a minimum of force, is related to the slant cut at point 51 on the latching teeth 38. This feature makes it possible to withdraw the teeth with less effort than required with conventionally shaped latching teeth. Because of the slant cut, the force of the spring biased tongue ejector 36 on the tongue tends to force the teeth to their unlatched condition once scotching block 26 has been removed from beneath the end of latch member 28. Although this effect is very slight, any increase in stress would increase this tendency toward expulsion of the teeth from the tongue, and certainly reduce the effort necessary to withdraw them.

As soon as the teeth are out of the tongue, spring 43 forces the tongue ejector foward. The tongue is forcibly ejected, and the covered portion 36 of the tongue ejector captures the projecting end 35 of the latch member in its depressed condition, thereby retaining the latching teeth in their unlatched position until released by the insertion of the tongue.

While I have described preferred embodiments of my invention, it will be understood that various modifications and changes can be made in the buckle and tongue combination described, without departing from the spirit of this invention or the scope of the following claims.

I claim:

1. A buckle for engaging a tongue comprising: a ferrule having a slot at one end for engaging a tongue; a latch member with at least one latching tooth, said latch member pivotally mounted on the ferrule for releasing motion between an engaged position and a disengaged position in reference to said tongue; a sliding release button mounted at the front of the buckle, and a tongue ejector mounted on said latch member and cooperating with the latch member and the release button for engaging and disengaging the tongue, said release motion of said latch member having a directional component which is parallel to the direction of motion of said tongue when said tongue is released from said buckle, withdrawal force on said tongue cooperating with said latch member to assist said release motion of said latch member, said buckle harnessing a portion of said withdrawal force on said tongue for use in releasing said latch member, said buckle thereby requiring a low release effort on said release button.

2. A buckle for engaging a tongue comprising: a ferrule having a slot at one end for engaging a tongue and a latch member with at least one latching tooth, said latch member straddling the ferrule and pivoted thereon for rotation in and out of latching engagement with corresponding openings in the tongue, said latch member having release motion between an engaged position and a disengaged position in reference to said tongue, wherein said latch member is urged in and out of latching engagement by a wedge means biased toward the front of the buckle and attached to a sliding release button accessible at the front of the buckle, said wedge means slideably positioned on the ferrule, whereby sliding the wedge means toward the rear rotates the latching tooth of the latch member out of engagement with the tongue, while sliding the wedge means toward the front rotates the latch member into its latched position, said release motion of said latch member having a directional component which is parallel to the direction of motion of said tongue when said tongue is released from said buckle, withdrawal force on said tongue cooperating with said latch member to assist said release motion of said latch member, said buckle harnessing a portion of said withdrawal force on said tongue for use in releasing said latch member, said buckle thereby requiring a low release effort on said release button.

3. The safety buckle and tongue combination of claim 2 wherein the latch member has two latching teeth and said combination further comprises: a slideable tongue ejector, spring biased for tongue ejection, has a rear section straddling the ferrule, adapted for capturing the end of the latch member at the moment of tongue ejection, to thus retain the latching teeth out of their latched position until released by the insertion of the tongue.

4. The safety buckle and tongue combination of claim 3 wherein the wedge means comprises two wedges facing each other on opposite sides of the latch member and a rear part of the latch member retained in its unlatched position by the tongue ejector, is seated in a depressed section of the coupling, whereby the wedges, and the sliding release button are restrained against their bias until released by the insertion of the tongue into the buckle.

5. The safety buckle and tongue combination of claim 3 wherein the inner edges of the latching teeth have a slant upward and backward, said slant cooperating with said tongue ejector to cause ejection of said tongue upon movement of said release button.

6. The safety buckle and tongue combination of claim 2 and further comprising: a component support member adapted to fit within the housing and provide guides and support for the moving parts of the buckle.

7. The safety buckle and tongue combination of claim 6 wherein the component support member has a lower lip contoured for guiding the tongue into the slot of the ferrule, said lower lip cooperating with a similar upper lip in the lower part of the face of the sliding release button, to together form an elongated slot for receiving the tongue and guiding it into the slot of the ferrule.

8. A safety buckle and tongue combination comprising:

(a) a housing;

(b) a ferrule having a longitudinal slot for accepting a tongue at one end, and means at the other end for the attachment of a passenger restraint;

(c) said tongue having at least one opening therethrough, so spaced that a portion of each opening remains exposed at the corresponding side of the ferrule when the tongue is positioned within the slot of said ferrule, said tongue also having means for the attachment of a passenger restraint;

(d) a latch member pivotally mounted on the ferrule, having at least one latching tooth extending downward from the latch member for engagement with the opening of the tongue;

(e) an elongated latch control member extending longitudinally along the top surface of the forepart of the ferrule and beneath the latch member for limited horizontal sliding action, said latch control member being attached to a sliding tongue release button, accessible at the front of the buckle;

(f) said sliding release button and the attached latch control member being biased toward the front of the ferrule;

(g) said latch control member having a first wedge and a second wedge on its upper surface, the first wedge adjacent to the forepart of the latch member, sloping forward and upward for rotating the latch member to its unlatched position as the latch control member slides towards the rear; the second wedge on the upper surface of the latch control member, shorter than the first and adjacent to the rear part of the latch member, sloping upward and backward from a depressed section of the surface of the latch control member, said depressed section being substantially shaped to accept the rear part of the latch member when said latch member is rotated back to its unlatched position; said second wedge rotating the latch member to its latched position;

(h) a tongue ejector having parallel sides separated by a distance greater than the width of the latch member, said ejector being adapted for limited longitudinal motion from a first position in contact with the tip of the inserted and latched tongue, to a second forward position toward which it is biased, in ejecting the unlatched tongue from the buckle; said parallel sides of the ejector being connected by a bridge over the ferrule, of a height such that in its forward travel, the bridge comes to rest directly over the rear part of the latch member when said latch member is unlatched and seated in said depressed section of the latch control member beneath it, thereby capturing the latch member in its unlatched position and retaining its rear part in the depression of the latch control member, and consequently preventing the slide release button and attached latch control member from moving outward in response to the bias applied to the slide release button.

9. A buckle for engaging a tongue, said buckle comprising:

a structural member having a longitudinal slot with an opening at one end for insertion of said tongue;

a latch member pivotally mounted on said structural member and having an engaged position for engaging said tongue and a disengaged position for releasing said tongue;

a sliding release button slidably mounted on said structural member and having a portion adjacent to said opening of said longitudinal slot for manipulating said button and releasing said tongue by a low release effort, said release button having blocking means for blocking said latch member in its engaged position; and biasing means for ejecting said tongue, said latch member having release motion when said latch member moves from said engaged position to said disengaged position for releasing said tongue after said latch member has been unblocked by said release button, said release motion of said latch member having a directional component which is parallel to the direction of motion of said tongue when said tongue is being released from said buckle, withdrawal force on said tongue cooperating with said latch member to assist said release motion of said latch member, said buckle harnessing a portion of said withdrawal force on said tongue for use in releasing said latch member, said buckle thereby requiring a low release effort on said release button.

10. The buckle according to claim 9 wherein said release button further comprises means for moving said latch member to its disengaged position.

11. The buckle according to claim 9 wherein said structure is a solid, elongated ferrule.

* * * * *